US008169176B2

(12) United States Patent
Yu et al.

(10) Patent No.: US 8,169,176 B2
(45) Date of Patent: May 1, 2012

(54) CONTROLLING METHOD FOR DRIVING A DRAWER OF A REFRIGERATOR

(75) Inventors: Ok Sun Yu, Seoul (KR); Yong Hwan Eom, Seoul (KR); Hyoun Jeong Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 558 days.

(21) Appl. No.: 12/345,984

(22) Filed: Dec. 30, 2008

(65) Prior Publication Data

US 2009/0248205 A1 Oct. 1, 2009

(30) Foreign Application Priority Data

Mar. 26, 2008 (KR) ..... 10-2008-0028100

(51) Int. Cl.
*H02P 1/04* (2006.01)
*H02P 3/00* (2006.01)
*G05B 5/00* (2006.01)

(52) U.S. Cl. ..... 318/466; 318/266; 318/568.13; 312/219

(58) Field of Classification Search ..... 318/266, 318/466, 568.13; 312/219
See application file for complete search history.

(56) References Cited

U.S. PATENT DOCUMENTS 5,280,227 A 1/1994 Bashark
5,392,951 A * 2/1995 Gardner et al. ..... 312/319.5
5,445,294 A * 8/1995 Gardner et al. ..... 221/1
5,899,083 A 5/1999 Peterson et al.
5,940,306 A * 8/1999 Gardner et al. ..... 700/244
6,130,621 A * 10/2000 Weiss ..... 340/5.28
6,751,909 B2 6/2004 Ranaudo
6,779,855 B2 * 8/2004 Hoffman ..... 312/219
7,063,398 B2 * 6/2006 Hoffman ..... 312/219
7,075,446 B2 7/2006 Schondelmaier et al.
7,197,888 B2 4/2007 LeClear et al.
7,282,884 B2 * 10/2007 Huber et al. ..... 318/646
7,293,845 B2 * 11/2007 Hoffman ..... 312/219
7,307,395 B2 12/2007 Bouamra et al.
7,407,210 B2 8/2008 Arbaugh et al.
7,484,817 B2 * 2/2009 Hoffman et al. ..... 312/219
7,533,947 B2 5/2009 Kim et al.
7,587,907 B2 9/2009 Kim et al.
7,594,707 B2 9/2009 Kunkle et al.
7,602,135 B2 10/2009 Huber et al.
7,633,258 B2 12/2009 Huber et al.

(Continued)

FOREIGN PATENT DOCUMENTS

CN 2406551 A 11/2000

(Continued)

OTHER PUBLICATIONS

International Search Report dated Dec. 8, 2008.

(Continued)

*Primary Examiner* — Paul Ip
(74) *Attorney, Agent, or Firm* — KED & Associates, LLP

(57) ABSTRACT

A movement structure for a drawer of a refrigerator is provided. The movement structure may a storage box to be automatically withdrawn from or inserted into a storage compartment of the refrigerator by pressing a button. This automatic movement of the storage box may allow the storage box to be easily withdrawn from and inserted into the storage compartment regardless of a weight of items stored in the storage box.

16 Claims, 10 Drawing Sheets

U.S. PATENT DOCUMENTS

| | | | | |
|---|---|---|---|---|
| 7,641,707 | B2 | 1/2010 | Kang et al. | |
| 7,688,015 | B2 * | 3/2010 | Wenzel et al. | 318/466 |
| 7,731,314 | B2 | 6/2010 | Kim | |
| 7,784,888 | B2 | 8/2010 | Oh et al. | |
| 7,802,515 | B2 | 9/2010 | Suetsugu | |
| 7,812,561 | B2 * | 10/2010 | Hagen et al. | 318/568.13 |
| 7,859,203 | B2 | 12/2010 | Miyashita | |
| 2001/0009360 | A1 | 7/2001 | Jin | |
| 2002/0171335 | A1 | 11/2002 | Held | |
| 2003/0078710 | A1 | 4/2003 | Li | |
| 2004/0035129 | A1 | 2/2004 | Kaiser | |
| 2004/0100165 | A1 * | 5/2004 | Hoffman | 312/219 |
| 2004/0100166 | A1 * | 5/2004 | Hoffman | 312/219 |
| 2004/0100169 | A1 | 5/2004 | Huber et al. | |
| 2004/0138843 | A1 | 7/2004 | Bouamra et al. | |
| 2005/0284113 | A1 | 12/2005 | Jang et al. | |
| 2006/0061245 | A1 | 3/2006 | Huber et al. | |
| 2006/0087207 | A1 | 4/2006 | Oh et al. | |
| 2006/0087208 | A1 | 4/2006 | Oh et al. | |
| 2006/0096304 | A1 * | 5/2006 | Kim et al. | 62/132 |
| 2006/0104756 | A1 * | 5/2006 | Kim et al. | 414/288 |
| 2006/0196198 | A1 * | 9/2006 | Kim et al. | 62/131 |
| 2006/0207283 | A1 * | 9/2006 | Kim et al. | 62/407 |
| 2006/0226749 | A1 | 10/2006 | Kim | |
| 2006/0242988 | A1 | 11/2006 | Kim et al. | |
| 2006/0261775 | A1 * | 11/2006 | Huber et al. | 318/646 |
| 2006/0267461 | A1 * | 11/2006 | Hoffman | 312/219 |
| 2007/0013274 | A1 * | 1/2007 | Hoffman | 312/219 |
| 2007/0170828 | A1 * | 7/2007 | Hoshide et al. | 312/319.5 |
| 2007/0256036 | A1 * | 11/2007 | Johnson et al. | 715/866 |
| 2008/0018215 | A1 | 1/2008 | Carden et al. | |
| 2008/0110092 | A1 | 5/2008 | Takahashi | |
| 2008/0116777 | A1 | 5/2008 | Kappler et al. | |
| 2008/0163639 | A1 | 7/2008 | Hwang | |
| 2008/0302114 | A1 | 12/2008 | Kelly et al. | |
| 2009/0091223 | A1 * | 4/2009 | Hagen et al. | 312/330.1 |
| 2009/0102338 | A1 * | 4/2009 | Wenzel et al. | 312/319.1 |
| 2009/0160297 | A1 | 6/2009 | Anikhindi et al. | |
| 2009/0199484 | A1 * | 8/2009 | Zipp | 49/358 |
| 2009/0206715 | A1 * | 8/2009 | Scheffknecht et al. | 312/319.8 |
| 2009/0243454 | A1 * | 10/2009 | Yoo et al. | 312/405.1 |
| 2009/0248205 | A1 * | 10/2009 | Yu et al. | 700/275 |
| 2009/0248207 | A1 * | 10/2009 | Yoo et al. | 700/275 |
| 2009/0254221 | A1 * | 10/2009 | Kang | 700/275 |

FOREIGN PATENT DOCUMENTS

| | | | |
|---|---|---|---|
| CN | 1468569 | A | 1/2004 |
| EP | 0 779 484 | | 6/1997 |
| JP | 02-103388 | | 4/1990 |
| JP | 02-106686 | | 4/1990 |
| JP | 02-136686 | | 5/1990 |
| JP | 02-146487 | | 6/1990 |
| JP | 03-045820 | | 2/1991 |
| JP | 07-174459 | | 7/1995 |
| JP | 11-094455 | | 4/1999 |
| JP | 2005-326044 | | 11/2005 |
| JP | 2006-023039 | | 1/2006 |
| JP | 2006-046741 | | 2/2006 |
| JP | 2006-046748 | | 2/2006 |
| JP | 2006-145055 | | 6/2006 |
| JP | 2006-250485 | | 9/2006 |
| JP | 2007-017018 | | 1/2007 |
| JP | 2007-093208 | | 4/2007 |
| JP | 2007-132605 | | 5/2007 |
| JP | 2008-8550 | | 1/2008 |
| JP | 2008-196744 | | 8/2008 |
| JP | 2008-196752 | | 8/2008 |
| JP | 2009-036433 | | 2/2009 |
| KR | 1999-003684 | | 1/1999 |
| KR | 20-0301747 | | 1/2003 |
| KR | 20-0334077 | | 11/2003 |
| KR | 2006-0025806 | | 3/2006 |
| KR | 10-0634366 | | 10/2006 |
| KR | 2007-008046 | | 1/2008 |
| WO | WO 2006/126584 | | 11/2006 |
| WO | WO 2007/009783 | | 1/2007 |

OTHER PUBLICATIONS

International Search Report dated Dec. 3, 2008.

International Search Report issued in PCT Application No. PCT/KR2010/001497 dated Oct. 22, 2010.

International Search Report issued in PCT Application No. PCT/KR2010/001496 dated Oct. 22, 2010.

International Search Report issued in PCT Application No. PCT/KR2010/001495 dated Oct. 25, 2010.

International Search Report issued in PCT Application No. PCT/KR2010/001410 dated Oct. 25, 2010.

International Search Report issued in PCT Application No. PCT/KR2010/001409 dated Oct. 25, 2010.

Chinese Office Action issued in CN Application No. 2011092100646340 dated Sep. 26, 2011.

U.S. Office Action issued in U.S. Appl. No. 12/510,372 dated Nov. 30, 2011.

U.S. Office Action issued in U.S. Appl. No. 12/345,946 dated May 19, 2011.

U.S. Office Action issued in U.S. Appl. No. 12/390,520 dated Apr. 22, 2011.

U.S. Office Action issued in U.S. Appl. No. 12/390,524 dated Aug. 25, 2011.

U.S. Office Action issued in U.S. Appl. No. 12/345,946 dated Sep. 26, 2011.

U.S. Office Action issued in U.S. Appl. No. 12/390,523 dated Feb. 7, 2012.

U.S. Office Action issued in U.S. Appl. No. 12/390,527 dated Feb. 14, 2012.

U.S. Office Action issued in U.S. Appl. No. 12/724,558 dated Mar. 14, 2012.

* cited by examiner

CONTROLLING METHOD FOR DRIVING A DRAWER OF A REFRIGERATOR

This application claims priority under 35 U.S.C. 119 and 35 U.S.C. 365 to Korean Patent Application No. 10-2008-0028100, filed in Korea on Mar. 26, 2008, which is hereby incorporated by reference in its entirety.

BACKGROUND

1. Field

This relates to a controlling method for driving a drawer of a refrigerator.

2. Background

A refrigerator is an appliance for the storage of fresh food. Refrigerators may generally be categorized into top freezer types, bottom freezer types, and side-by-side refrigerators, depending on the respective positions of the freezer and refrigeration compartments.

For example, the bottom freezer configuration has the freezer compartment positioned below the refrigeration compartment. In the bottom freezer configuration, a door that pivots about an edge of the main body may open and close the refrigeration compartment, and a door that opens and closes the freezer compartment may be provided with a storage box door that moves forward and rearward relative to the main body. Because in this configuration the freezer compartment is provided below the refrigeration compartment, a user stoops to grasp and pull the door forward in order to open the freezer compartment. A system to facilitate the opening and/or closing of such a freezer compartment would enhance the utility of a bottom freezer type refrigerator. Further, a system to facilitate opening and/or closing of a drawer in a refrigerator would enhance user convenience.

BRIEF DESCRIPTION OF THE DRAWINGS

The embodiments will be described in detail with reference to the following drawings in which like reference numerals refer to like elements wherein.

DETAILED DESCRIPTION

Figure 1:
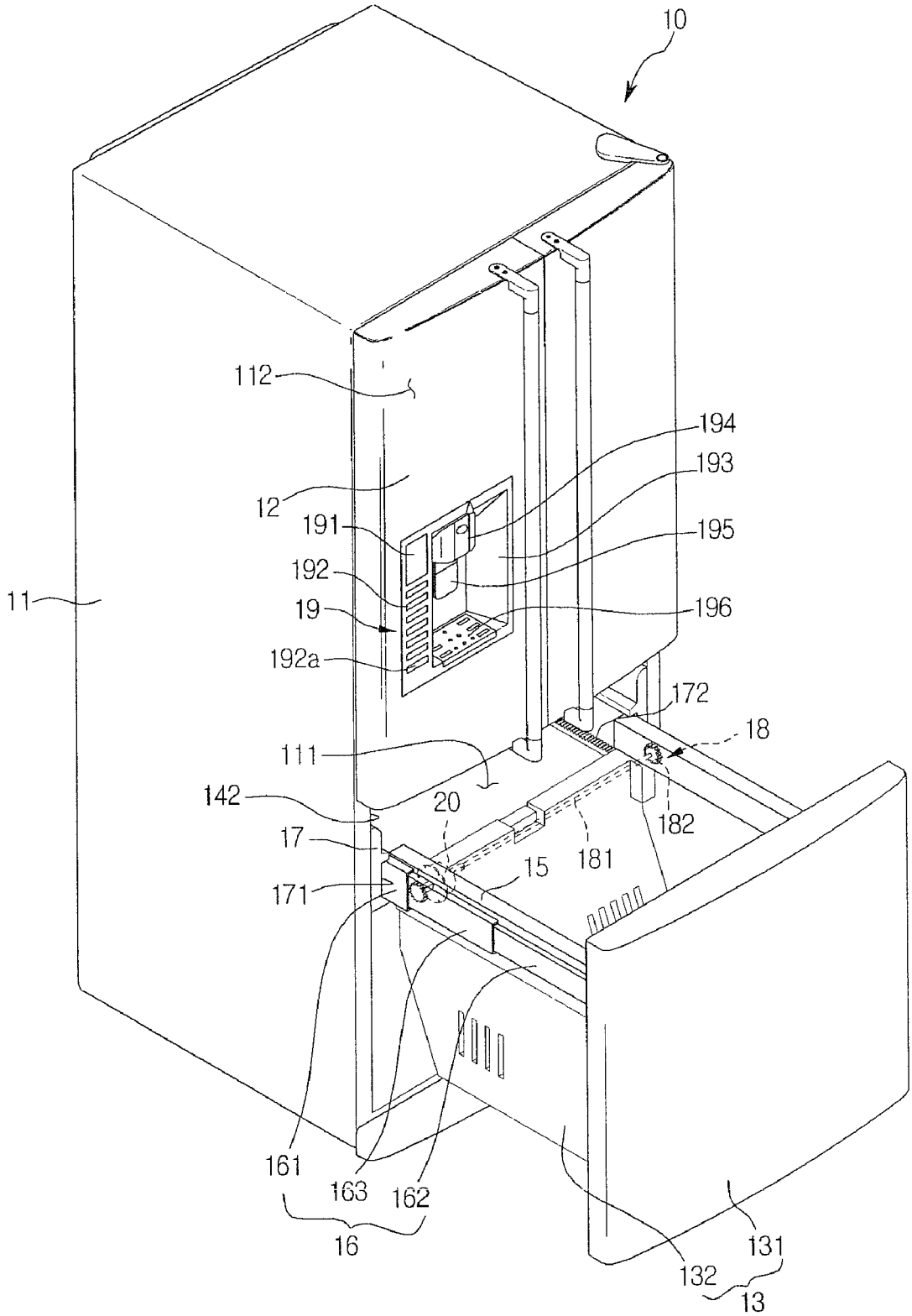
FIG. 1 is a perspective view of an exemplary refrigerator provided with a drawer movement structure according to an embodiment as broadly described herein.

To facilitate the opening and/or closing of a compartment of a refrigerator, such as, for example, a lower freezer compartment, an automatic opening configuration may be provided. This automatic opener may determine when a user intends to open a compartment door by sensing a gripping or grasping of a door handle as the compartment door is moved a predetermined distance forward from the front surface of the main body, and then automatically moving the door, and the storage box to which it is coupled, to an open position. A motor may be provided with the appropriate compartment, and a rotating member such as, for example, a gear may be connected to a shaft of the motor. As an undersurface of the storage box comes into contact with the rotating member, the storage box moves forward and rearward based on a direction of the rotation of the rotating member.

However, when using this type of automatic opener, a user still grasps and exerts a pulling force on the handle to initiate the automatic opening. Typically, a sealing member such as, for example, a gasket may be attached to the rear surface of the storage box to prevent cold air leakage, and an adhering member such, for example, as a magnet may be provided inside the sealing member to maintain a tight seal therebetween. Thus in order to initiate movement of the storage box, a user grasps and pulls the storage box with a force greater than the magnetic force. In addition, when the storage box is provided at the bottom of the refrigerator, a user stoops to pull it out, which may be physically challenging for children, the elderly, and smaller users. Also, the handle protrudes from the front surface of the storage box, thereby increasing the dimensions for the packaging and installation of the refrigerator and presenting a potential hazard for users who may collide with the handle. It is difficult or not possible to omit the handle in this type of automatic opener.

Further, the time it takes for a user to grasp a handle and initiate movement of the storage box, coupled with the time it takes for a controller to sense this movement and provide for automated movement of the storage box may be excessive, thus reducing utility. Additionally, the automatic opener may only move the storage box a distance adequate to separate it from the refrigerator main body, and thus a user still directly grasps the handle and pulls the storage box further forward thereafter. When the weight of food stored in the storage box may be considerable, withdrawing the storage box in this manner may be difficult.

By providing a drive motor and a gear assembly on the floor of the refrigeration compartment or the freezer compartment to provide for movement of a storage box provided therein, the storage space within the refrigerator may be reduced by the volume consumed by the motor and gear assembly. This may also result in a loss of insulation in the refrigerator main body. That is, if the inner case were to be recessed to receive a motor, an insulating layer between the inner case and an outer case of the main body would become thinner, thus reducing insulation between the inside and outside of the refrigerator.

Further, if movement of the storage box is driven by this type of motor and gear assembly, such a gear assembly would likely include a rack that engages a gear, the rack extending from front to rear along the floor of the storage box. Thus, the length of the rack would necessarily be limited by the overall length of the floor of the storage box. For example, the rear surface of a freezer compartment storage box in a bottom freezer refrigerator may be sloped to accommodate a machine room provided at a lower rear portion of the refrigerator. Thus the length of the lower portion of the freezer compartment storage box may be less than the length of the upper portion thereof, limiting accessibility to the interior of the storage box. If a plurality of storage boxes are provided one on top of another, a separate motor and gear assembly may be provided for each storage box, thereby complicating the support structure required for the stack storage boxes.

Additionally, the automatic opener described above may include a mechanism such as, for example, a switch, to simply sense whether or not the storage box has been fully withdrawn or closed. However, this switch would not be necessarily sense whether or not the storage box is being withdrawn at a normal speed, whether or not the withdrawing of the storage box is impeded by obstacles, and whether or not the storage box is being withdrawn at a set speed regardless of the weight of food stored therein.

Figure 2:
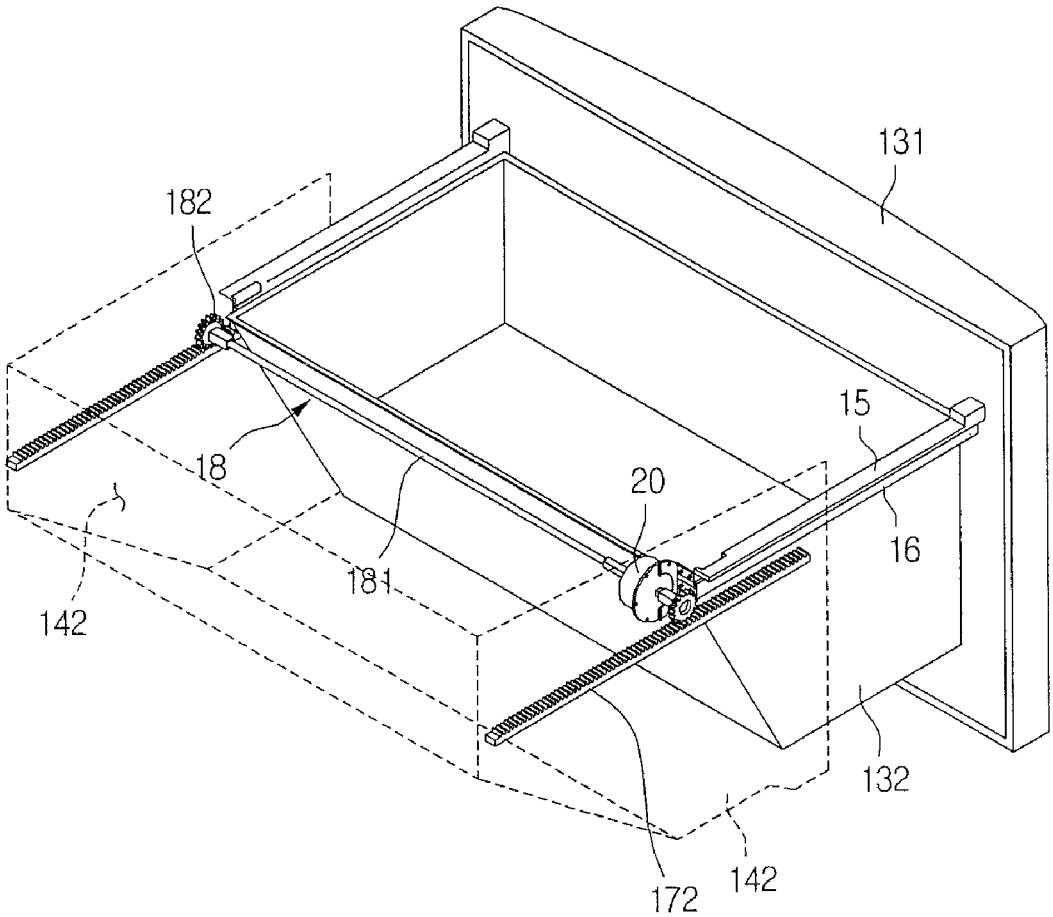
FIG. 2 is a perspective view of a storage box assembly for the exemplary refrigerator shown in FIG. 1.

The exemplary bottom freezer type refrigerator 10 shown in FIGS. 1 and 2 may include a main body 11 that defines a refrigeration compartment 112 and a freezer compartment 111. A refrigeration compartment door 12 may rotatably installed on the front of the main body 11 to open and close the refrigeration compartment, and a drawer 13 may be provided below the refrigeration compartment. The drawer 13 may be inserted into and withdrawn from the inside of the freezer compartment 111 so that goods or items stored therein may be accessed as necessary.

The drawer 13 may include a door 131 that forms a front exterior of the drawer 13 and a storage box 132 provided behind the door 131 to receive store food items. A frame 15 may extend rearward from a rear of the freezer compartment door 131 to support opposite side edges of the storage box 132, and a rail assembly 16 may be positioned corresponding to the frame 15 to allow the storage box 132 to be inserted into and withdrawn from the freezer compartment 111. The rail assembly 16 may have a first end fixed to an inner surface of the freezer compartment 111 formed by an inner case 142 of the refrigerator 10, and a second end fixed to the frame 15 to allow the rail assembly 16 to be adjusted in length and to allow the storage box 132 to be inserted into and withdrawn from the freezer compartment 111 along the rail assembly 16.

The refrigerator 10 may also include an anti-wobble, or alignment apparatus for preventing wobbling or mis-alignment as the storage box 132 is withdrawn from or inserted into the freezer compartment 111. A rail guide 17 provided at one or both opposite sides of the freezer compartment 111 corresponding to the rail assembly 16 to hold and guide the rail assembly 16, and a movement apparatus for automatically moving, that is, withdrawing and inserting, the storage box 132 relative to the freezer compartment 111. In detail, the alignment apparatus may include a suspended portion 18 coupled to the rear of the frame 15 to prevent lateral wobbling or uncoordinated lateral movement when the storage box 132 is being withdrawn from or inserted into the freezer compartment 111, and a guide member provided on the rail guide 17 to guide the movement of the suspended portion 18. The guide member may include a rail mounting recess 171 formed in the rail guide 17 to receive the rail assembly 16 and a guide rack 172 that extends from front to rear at the bottom of the rail mounting recess 171.

The suspended portion 18 may include a shaft 181 with its opposite ends connected to a respective portion of the frame 15 provided on opposite sides of the storage box 132, and a pinion 182 provided respectively at one or both ends of the shaft 181. A plurality of gears may be formed on the outer peripheral surface of the pinion 182, and a corresponding plurality of gear teeth may be formed on the upper surface of the guide rack 172 to engage the pinion 182. Accordingly, when the pinion 182 rotates in an engaged state with the guide rack 172, the pinion 182 rolls along the guide rack 172 to in turn move the storage box 132, and the drawer 13 is not biased to the left or right, but is withdrawn in a straight path. Thus, the shaft 181, pinion 182 and guide rack 172 prevent the drawer 13 from wobbling or moving laterally.

In certain embodiments, the drawer 13 may be withdrawn from the refrigerator 10 automatically. For this purpose, the drawer movement apparatus may include a driving force generator coupled to one or all of the pinions 182 to impart a rotational force on the pinions 182, and a driving force transmitter that transmits the driving force from the driving force generator to the pinions 182 to allow the storage box 132 to be moved. The driving force generator may be, for example, a drive motor 20 that provides rotational force to the pinions 182 and the driving force transmitter may be, for example, an anti-wobble or alignment apparatus including the suspended portion 18 and the guide rack 172 as described above. That is, the alignment apparatus may prevent lateral misalignment wobbling of the drawer 13, while also transmitting a driving force that automatically moves the drawer 13. The driving force generator may be provided with the freezer compartment door 131, and may include a drive motor 20 or other driving means capable of automatically moving the drawer 13, such as, for example, an actuator employing a solenoid.

The rail assembly 16 may include a fixed rail 161 fixed to the rail mounting recess 171, a moving rail 162 fixed to the frame 15, and an extending rail 163 that extends between the fixed rail 161 and the moving rail 162. Depending on a front-to-rear length of the storage box 132, the rail assembly 16 may include one or more extending tails 163. In certain embodiments, the rail assembly 16 may include only the fixed rail 161 and the moving rail 162. Additionally, the shaft 181 and the drive motor 20 may be provided at a rear of the frame 15, or may be provided at a rear of the moving rail 162, depending on the particular storage box 132/refrigerator 10 design. The storage box 132 may be detachably coupled to the frame 15 to allow the storage box 132 to be removed from the refrigerator 10 for periodic cleaning.

A dispenser 19 for dispensing water or ice may be provided at the front of the refrigeration compartment door 12. The dispenser 19 may include a receptacle 193 comprising a recess having a predetermined depth, and a chute 194 and a dispensing tap (not shown in detail) through which ice and water may be dispensed by actuating a lever 195. A water pan 196 may be provided on the floor of the receptacle 193. A display 191 for displaying various data such as, for example, an operating state of the refrigerator 10 and a temperature inside the refrigerator 10, and a button panel 192 including various input buttons 192*a*, may be provided with the dispenser 19. Various commands for withdrawing and inserting the storage box 132 may be input using the input buttons 192*a*.

An input button 192*a* for entering a command to withdraw the storage box 132 from or insert the storage box 132 into the refrigerator 10 may be provided in various formats such as, for example, a capacitive switch employing changes in electrostatic capacitance, a tact switch, a toggle switch, or other type of switch as appropriate. Additionally, although the input button 192*a* shown in FIG. 1 is provided at one side of the dispenser 19, the button panel 192 and/or input buttons 192*a* may alternatively be provided in a touch button configuration on a front or side surface of the refrigerator or freezer compartment door as appropriate, and not necessarily with the dispenser 19.

For example, if the input button 192*a* were provided on the front surface of the freezer compartment door 131, the input button 192*a* may include a vibration sensor switch that operates by detecting vibrations transferred to the freezer compartment door 131. That is, if, for example, a user is unable to use either hand to initiate the opening of the door 131, and instead imparts a gentle shock with, for example, a foot, to the freezer compartment door 131, the vibration transferred from the shock may be sensed and the drive motor 20 may be operated to withdraw the storage box 132 from the freezer compartment 111.

In alternative embodiments, the input button 192*a* may instead be provided on a separate remote control unit that controls various other functions of the refrigerator, or other devices within a given range. For example, an input button 192*a* that controls movement of the drawer 23 may be provided with a remote control unit that controls, for example, internal temperatures of the various compartments of the refrigerator, operation of a display module/television mounted on a surface of the refrigerator, and the like.

Alternatively, two or more input buttons 192*a* may be provided such as, for example, a withdrawal input button and an insertion input button. Although in the following embodiments, the manipulation of the input button for withdrawing and inserting the drawer is described with reference to only one input button, it is well understood two or more input buttons may be provided to separately control the withdrawal and insertion of the drawer.

Figure 3:
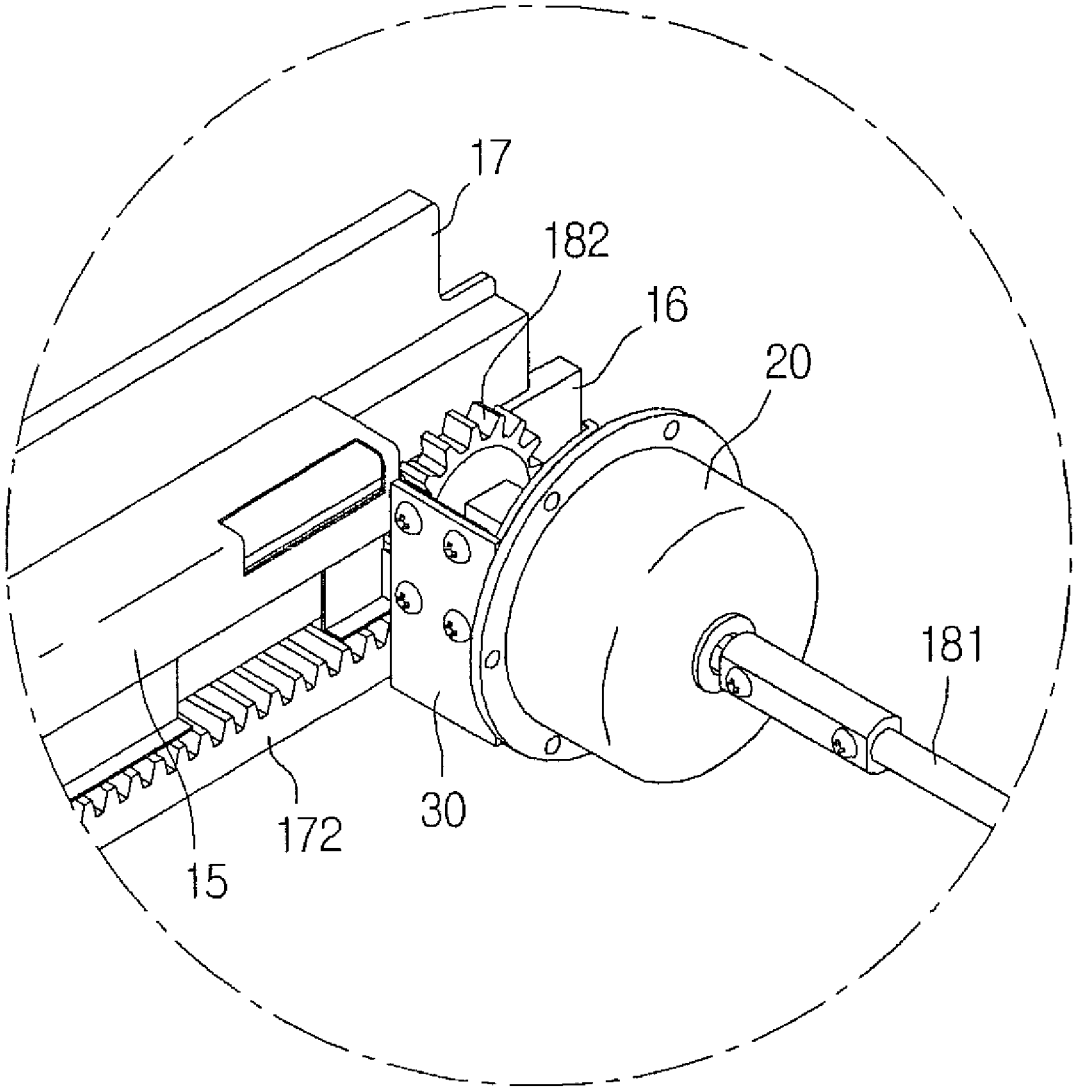
FIG. 3 is a detailed perspective view of a drawer movement apparatus according to an embodiment as broadly described herein.
Figure 4:
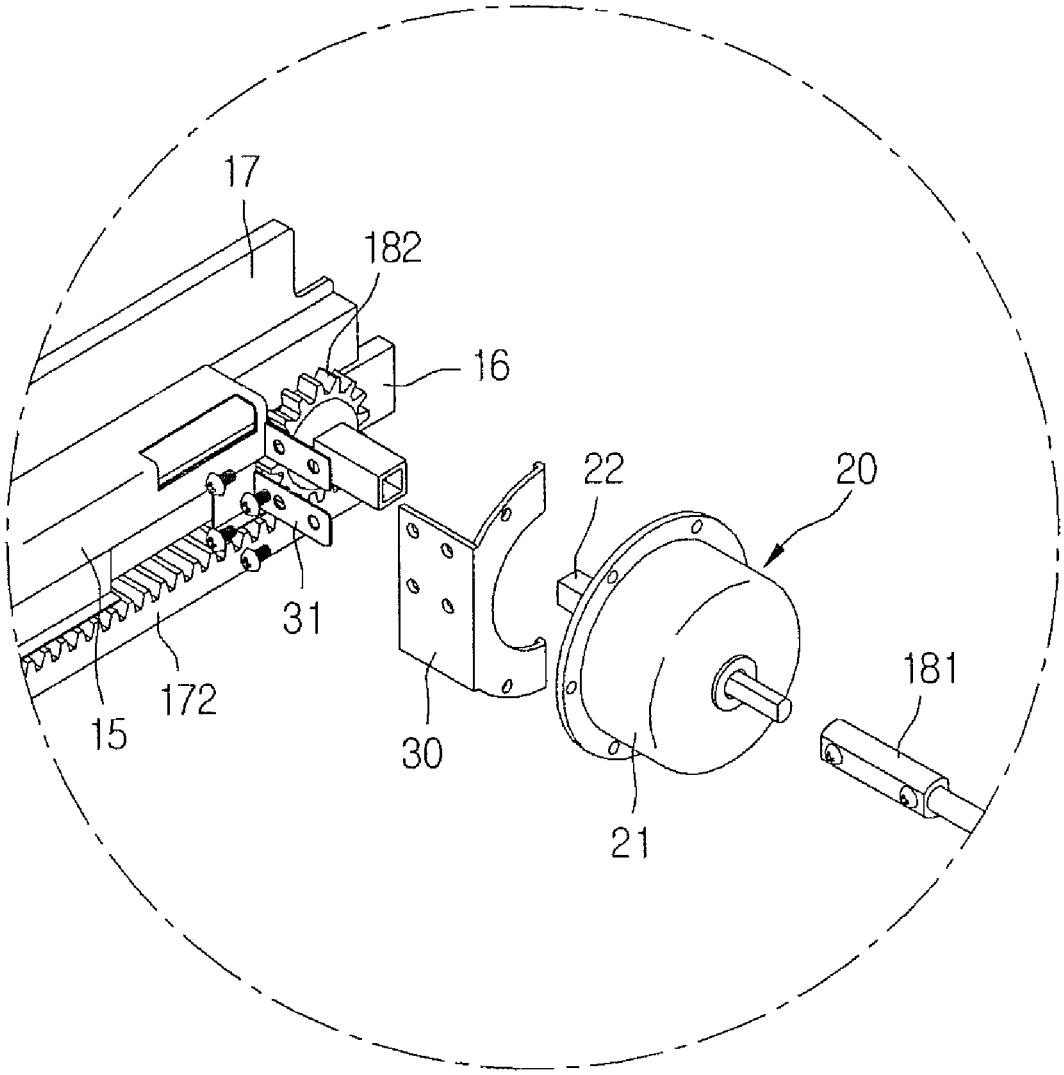
FIG. 4 is an exploded perspective view of the drawer movement apparatus shown in FIG. 3.

A drawer movement apparatus according to an embodiment as broadly described herein is shown in more detail in FIGS. 3 and 4. As discussed above, the anti-wobble, or alignment apparatus may include the suspended portion 18 and the guide rack 172, and the suspended portion 18 may include the shaft 181 and the pinion 182. Although in this embodiment the guide rack 172 and the pinion 182 form the alignment apparatus, these elements may be structured differently as long as they perform the anti-wobble and/or alignment function. For example, a roller surrounded by a friction member may be used instead of the pinion 182, and a friction member that contacts the roller, instead of the guide rack 172, to generate friction may be used to slide the storage box 132 into and out of the refrigerator 10 without slippage.

The drive motor 20 may be an inner rotor type motor, and the pinion 182 may be connected to a motor shaft 22 connected to the rotor. The drive motor 20 may be any motor capable of both forward and reverse rotation and variable speed operation.

Such a rotor and stator, or other components forming the drive motor 20, may be protected by a housing 21. A fastening mount 31 may extend from the frame 15, and the fastening mount 31 and the housing 21 of the drive motor 20 may be coupled by a bracket 30. Accordingly, the assembly of the drive motor 20 and the suspended portion 18 may be fixedly coupled to a rear portion of the frame 15, and the pinion 182 may be coupled to the motor shaft 22 so that pinion 182 may be rotated by the motor 20.

The drive motor 20 may be fixed to the frame 15 by various methods which all fall within the spirit and scope as presented herein. Also, the drive motor 20 may be fixed to the rear of the moving rail 162 instead of to the frame 15. In alternative embodiments, the drive motor 20 may be integrally provided with the frame 15.

Figure 5:
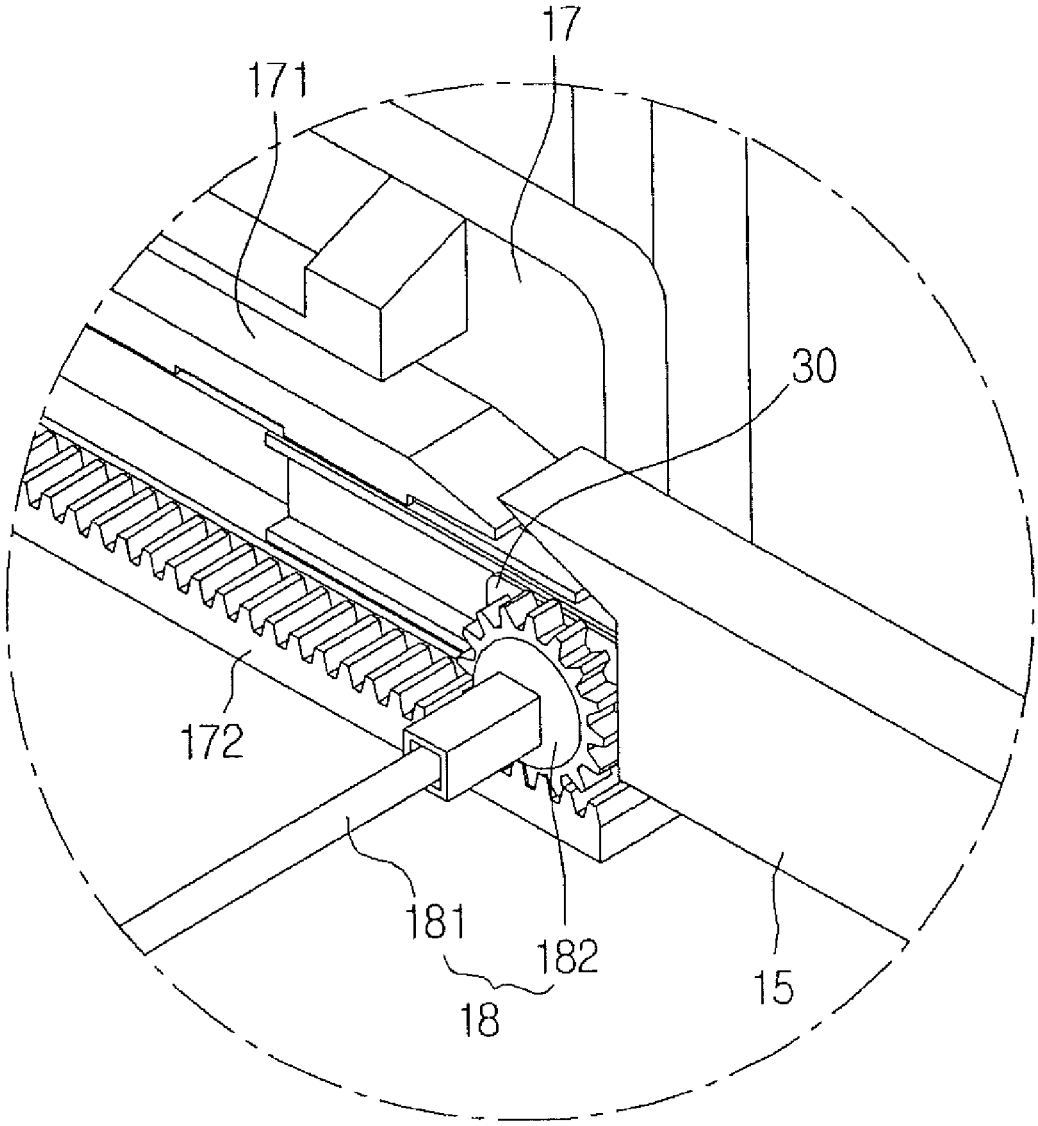
FIG. 5 is a partial perspective view of a suspended portion of the movement apparatus shown in FIG. 3.

The drive motor 20 shown in FIG. 5 is provided at only one end of the suspended portion 18. However, in alternative embodiments, a driving force generator, or drive motor 20, may be provided for each of the pinions 182 at opposite ends of the shaft 181. More specifically, as discussed above, a pinion 182 may be provided at each of the two opposite ends of the shaft 181. At an end of the suspended portion 18 to which a drive motor 20 is not provided, the shaft 181 may pass through the pinion 182 and be inserted into the frame 15. In other words, the bracket 30 provided at this side of the frame 15 may be respositioned such that the shaft 181 passes through the pinion 182 and is inserted into the bracket 30 to securely couple the shaft 181 to the frame 15 and prevent disengagement of one end of the storage box 132 from the frame 15 or lateral wobbling/mis-alignment of the storage box 132 during withdrawal and insertion of the storage box 132.

Alternatively, the end of the shaft 181 may instead be inserted into a rear portion of the moving rail 162, as described above.

The automatic movement process of a storage box 132 from a refrigerator 10 provided with a storage box movement apparatus as embodied and broadly described herein will now be discussed.

In order to withdraw the storage box 132 from a corresponding compartment of the refrigerator 10, a user first actuates an input button 192*a*, which, as discussed above, may be provided at one side of the dispenser 19, on a surface of the refrigerator 10, or on a remote control unit, as appropriate. Similarly, actuation of the input button 192*a* may be accomplished by simply pushing the button 192*a*, or by imparting an external shock to an appropriate portion of the refrigerator 10 to actuate a vibration sensor switch. When the input button 192*a* is actuated to initiate a storage box withdrawing command, the command is transmitted to a controller (not shown in detail) of the refrigerator 10. The controller of the refrigerator 10 transmits an operation signal to a drive motor controller that controls the operation of the drive motor 20. This operation signal may include, for example, directional data for moving the storage box 132 either out of or into the refrigerator 10, and moving speed data for the storage box 132. That is, the directional data indicates which direction the drive motor 20 should be rotated, and the speed data indicates a number of revolutions per minute (RPM) of the drive motor 20 to achieve a particular speed.

The drive motor 20 may then be driven according to the operation signal in order to move the door 131 and storage box 132 accordingly. This allows the storage box 132 to be automatically withdrawn from the refrigerator 10 without requiring a user to apply a specific, physical withdrawing movement, thus eliminating the need for a separate handle member on the front surface of the door 131. Thus, the door 131 may have a flush front surface without any protrusions to provide a clean exterior finish, and to provide an inner cover coupled to the rear of the outer cover with an insulator interposed therebetween to preserve the insulative qualities of the refrigerator 10.

The controller of the refrigerator 10 may receive RPM data associated with the rotation of the drive motor 20 in real time, and may calculate the withdrawing speed (in m/s or other unit, as appropriate) of the storage box 132 accordingly. For example, using the rotating speed of the drive motor 20 and a circumferential value of the pinion 182, the moving speed of the storage box 132 can be calculated per unit time. Using this data, the storage box 132 may be withdrawn at a preset speed, regardless of the weight of food stored in the storage box 132. In certain embodiments, the preset speed may be a speed which is selected by a user, and which may also be altered based on user preferences.

The storage box 132 may be continuously or intermittently withdrawn from or inserted into the refrigerator 10 according to how the input button 192*a* is manipulated. For example, the storage box 132 may be controlled so that it is completely withdrawn if the input button 192*a* is pressed once and/or held for a predetermined amount of time. Similarly, the storage box 132 may be controlled so that it is withdrawn in stages if the input button 192*a* is pressed repeatedly with a certain interval in between pressings. Other arrangements may also be appropriate.

The storage box 132 may also be controlled so that its movement is automatically stopped if the storage box 132 encounters an obstacle as the storage box 132 is moved.

The storage box 132 may be controlled so that it is stopped when it has been withdrawn a predetermined distance, and may be controlled so that it is either reinserted or withdrawn completely, based on the user's particular intentions. For example, if the storage box 132 has been stopped after being withdrawn a predetermined distance, the storage box 132 may then be completely withdrawn when a user pulls the freezer compartment door 131, or the storage box 132 may be re-inserted into the refrigerator 10 when a user pushes the freezer compartment door 131. In other words, even when the drive motor 20 does not operate, movement of the storage box 132 is not impeded by the drive motor 20.

If a storage box withdrawal command is input through the input button 192*a*, and the storage box 132 is not in a withdrawn or open state, or stops during withdrawal, this may be sensed and an error signal may be generated. The storage box 132 may be controlled so that it is automatically closed when left in a withdrawn or open state for more than a predetermined amount of time, in order to minimize cold air loss.

The storage box 132 of a refrigerator 10 according to embodiments as broadly described herein may not only be automatically withdrawn, but withdrawn manually as well. For example, in the event of a power outage where power cannot be supplied to the drive motor 20, or when a user does not manipulate the input button 192*a* but instead grasps and pulls or pushes the door 131 by hand, the storage box 132 is not subjected to resistance from the drive motor 20 and may be smoothly withdrawn or re-inserted into the refrigerator 10. In other words, even when the drive motor 20 does not operate, withdrawal of the storage box 132 is not impeded by the drive motor 20.

As an alternative to the drive motor 20 being connected to the controller of the refrigerator 10 by a plurality of signal wires and receiving power through a plurality of electrical wires, a charging apparatus may be provided with the drive motor 20 to eliminate the need for electrical wires, and a short range wireless transmitter-receiver system may be provided to eliminate the need for signal wires and electrical wires.

Although, for ease of discussion, the drawer movement apparatus has to this point been applied to the movement of a freezer compartment door in a bottom freezer type refrigerator, it is well understood that such an apparatus can be applied to advantageous effect in other types of household appliances. For example, a drawer movement apparatus as embodied and broadly described herein may be applied to a side-by-side refrigerator, a refrigerator having multiple segregated compartments stacked vertically and/or horizontally, and other arrangements as appropriate.

Figure 6:
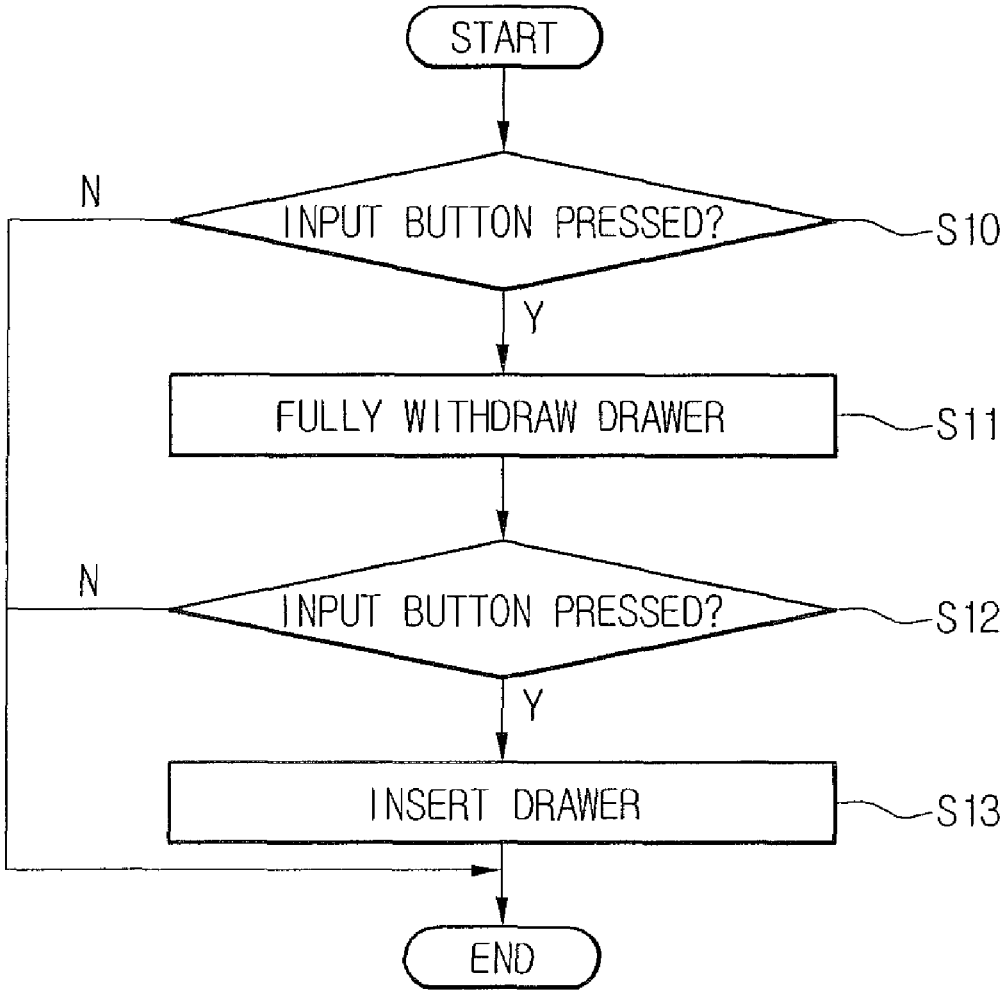
FIG. 6 is a flowchart of a method of driving a drawer of a refrigerator according to an embodiment as broadly described herein.

FIG. 6 is a flowchart of a method of driving a drawer of a refrigerator by pressing an input button.

First, the controller 810 determines that an input button 192*a* has been pressed to input a drawer withdrawing or inserting command (S10). If, for example, the input button 192*a* that has been pressed corresponds to a drawer withdrawing command, the drawer 13 is fully withdrawn to a maximum distance (S11). If the input button 192*a* is pressed again while the drawer 13 is fully withdrawn (S12), the drawer 13 is inserted back into the refrigerator 10 (S13).

Figure 7:
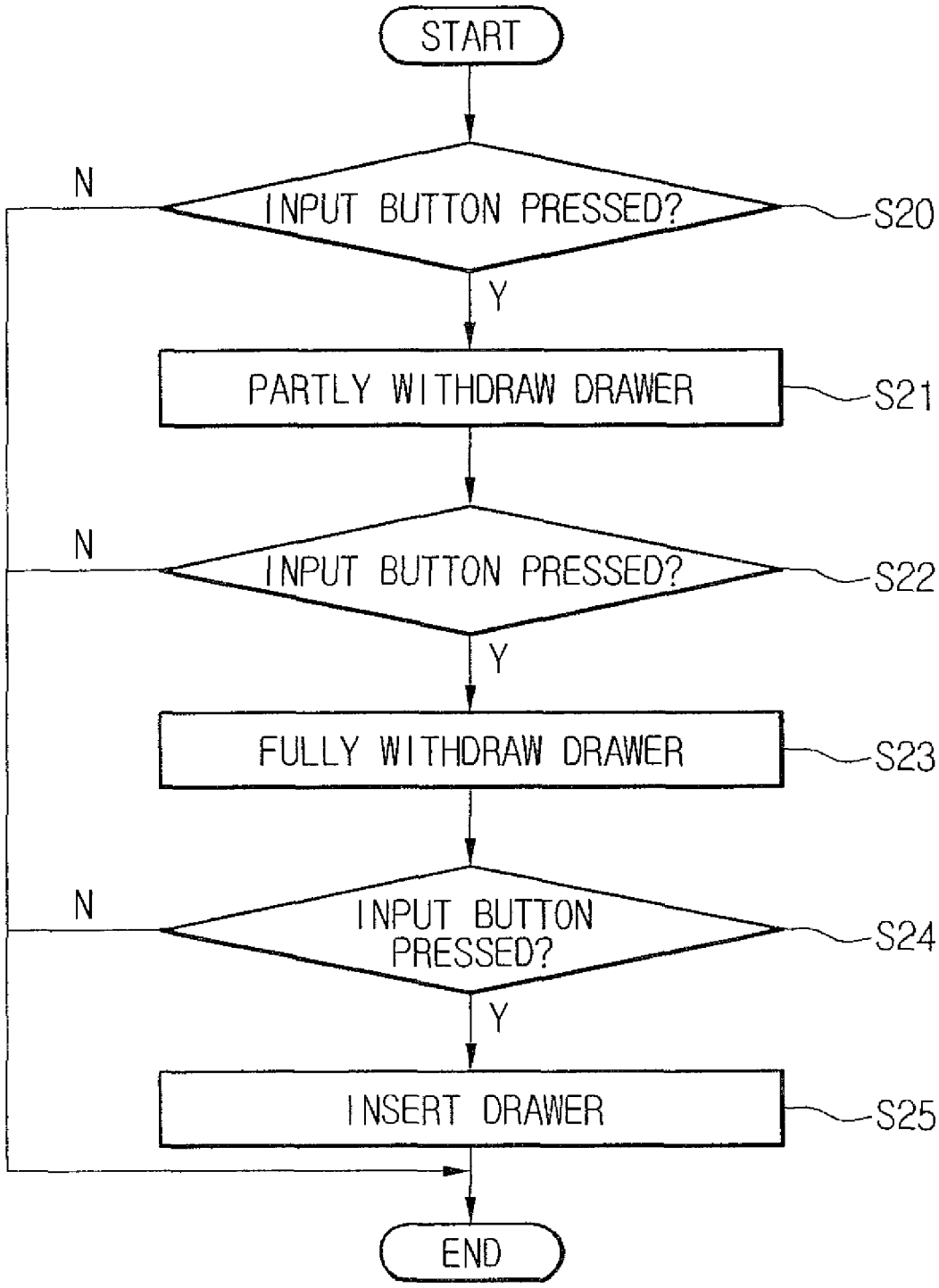
FIG. 7 is a flowchart of a method of driving a drawer of a refrigerator according to another embodiment as broadly described herein.

If the input button 192*a* is pressed again when the drawer 13 is fully inserted into the refrigerator 10, it is not necessary to always fully withdraw the drawer 13. That is, in certain embodiments the controller 810 may control the drawer 13 such that the drawer 13 may be partially withdrawn by a primary pressing of the input button 192*a*, and then fully withdrawn by a secondary pressing of the input button 192*a* using a multi-step drawer withdrawing procedure as shown in FIG. 7.

The controller 810 first determines if the input button 192*a* has been pressed (S20). When the input button 192*a* has been pressed the first time, the drawer 13 is partially withdrawn (S21). For example, the drawer 13 may be withdrawn by a distance that is ½ or ⅓ of the maximum withdrawing distance of the drawer 13. Thus, when the input button 192*a* is pressed again (S22), the drawer 13 may be fully withdrawn to its maximum distance (S23). When the input button 192*a* is pressed while the drawer 13 is fully withdrawn (S24), the drawer 13 may be inserted back into the refrigerator 10 (S25). Thus, the controller 810 may control the insertion of the drawer 13 such that the drawer 13 may be fully inserted when the insertion command is received.

Figure 8:
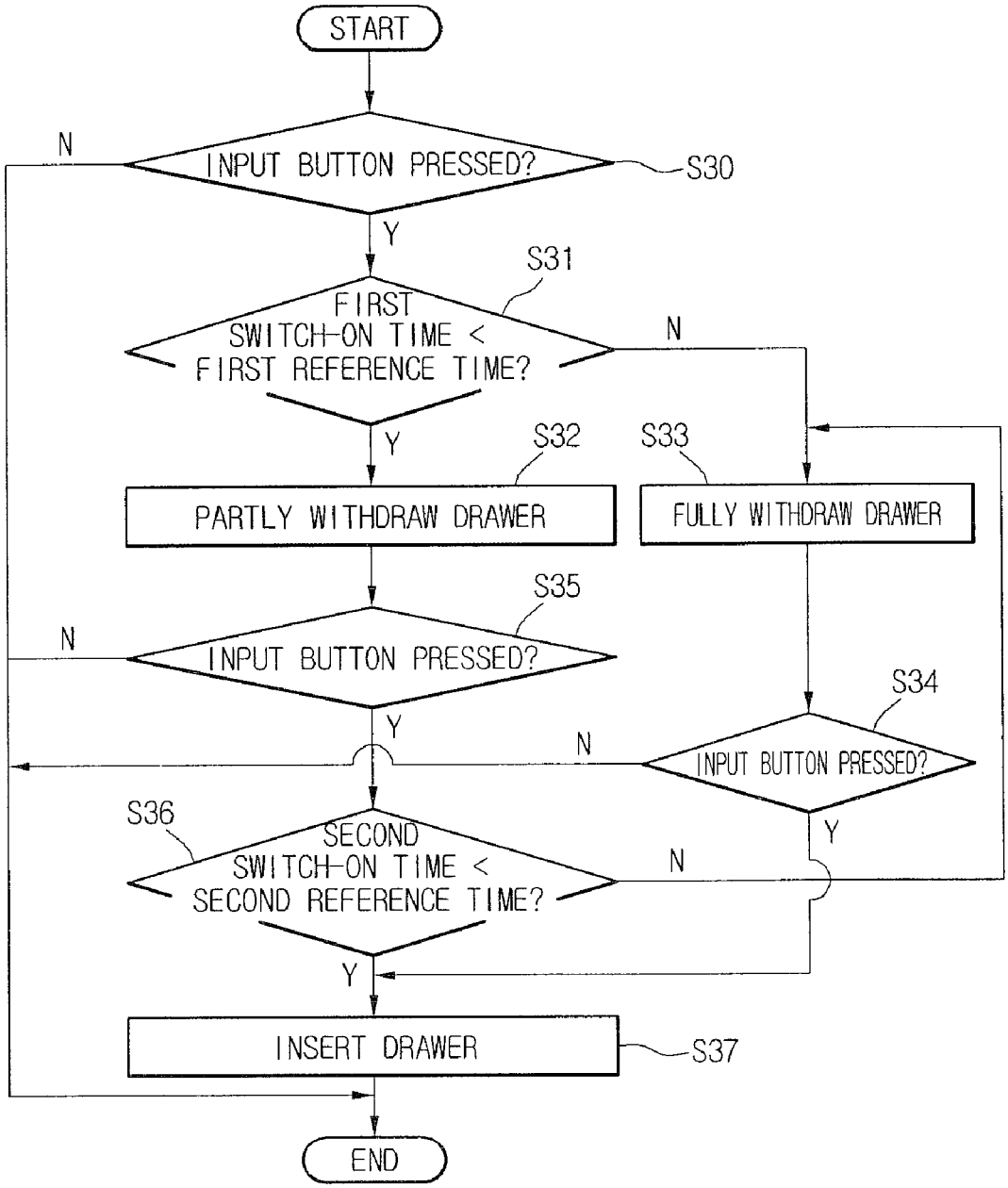
FIG. 8 is a flowchart of a method of driving a drawer of a refrigerator according to another embodiment as broadly described herein.

FIG. 8 is a flowchart of a method of driving a drawer of a refrigerator in which a distance the drawer 13 is moved may be determined in accordance with an amount of time the input button 192*a* is pressed and held.

When the input button 192*a* is first pressed (S30), the controller 810 initiates the counting of a first switch-on time at the pressing of the input button 192*a*, and compares the accumulated first switch-on time to a first reference time (S31). When the first switch-on time is less than the first reference time, the drawer 13 is partially withdrawn (S32). When the first switch-on time is greater than the first reference time, the drawer 13 is fully withdrawn (S33).

When the drawer 13 is partly withdrawn (S32) and the input button 192*a* is pressed again (S35), the controller 810 initiates the counting of a second switch-on time and compares the second switch-on time to the second reference time (S36). When the second switch-on time is less than the second reference time, the drawer 13 is closed (S37), and when the second switch-on time is greater than the second reference time, the drawer is fully opened (S33). When the input button 192*a* is pressed again (S34) in a state where the drawer 13 is fully withdrawn (S33), the controller 810 controls the drawer 13 such that the drawer 13 is inserted back into the refrigerator regardless of the switch-on time (S38). The first and second reference times may be set and/or altered by a user as appropriate, and may be the same value, or different values.

Figure 9:
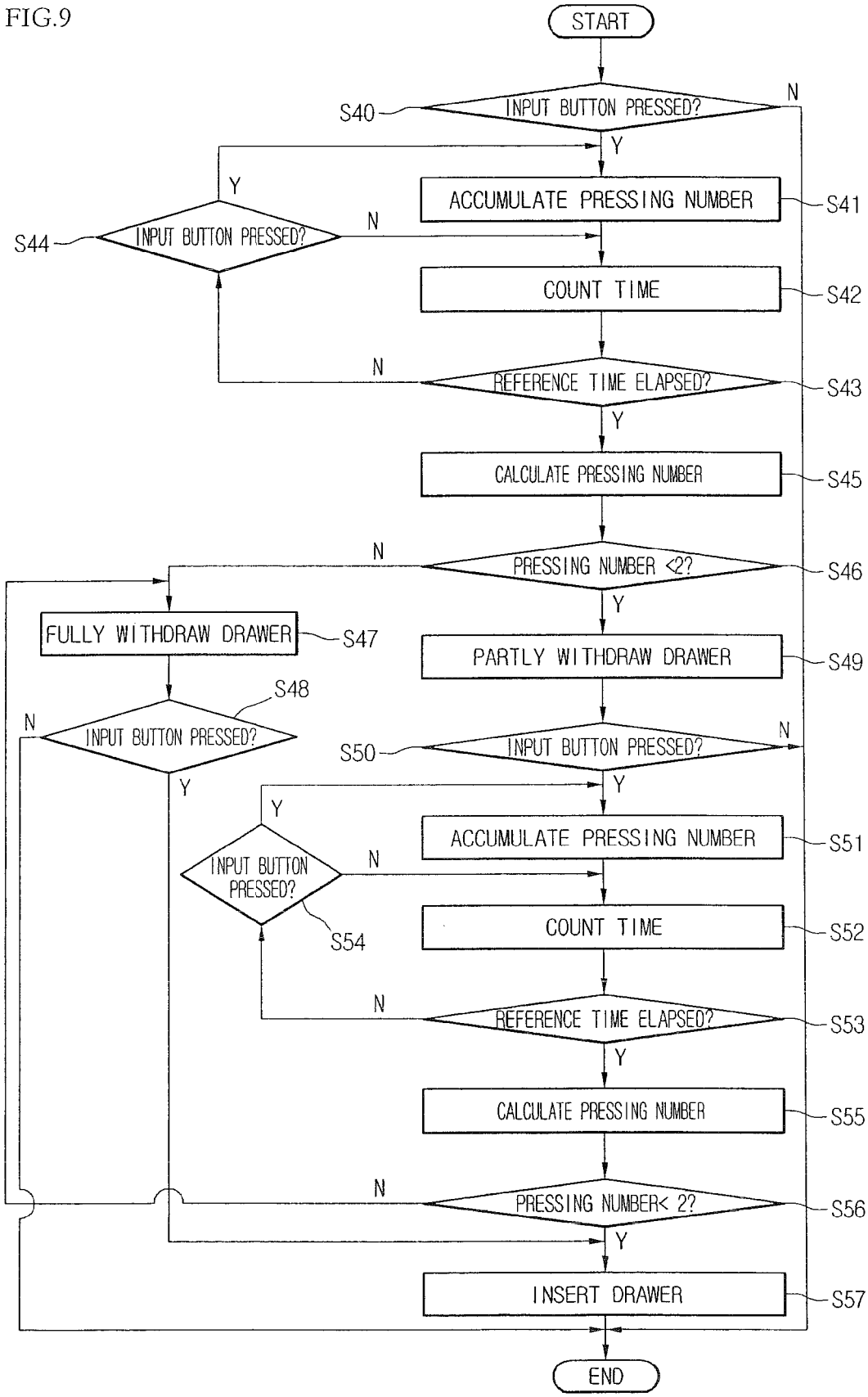
FIG. 9 is a flowchart of a method of driving a drawer of a refrigerator according to another embodiment as broadly described herein.

FIG. 9 is a flowchart of a method of driving a drawer of a refrigerator in which a drawer withdrawing condition is determined based on a number of times the input button 192*a* is pressed.

When the input button 192*a* is pressed (S40), a number of times the input button 192*a* is pressed is accumulated and stored in a memory (S41). At this point, the controller 810 also counts the time right after the input button is pressed (S42). The controller 810 then determines if a reference time has elapsed (S43) and also if the input button 192*a* has been pressed again within that reference time (S44).

When the input button 192*a* has been pressed again (S44) before the reference time has elapsed (S43), the controller 810 continues to count and accumulate the number of times the input button 192*a* has been pressed (S41) and simply keeps counting the time (S42).

When the reference time has elapsed (S43), the controller 810 calculates a number of times the input button 192*a* has been pressed during the reference time (S45) and determines a withdrawing condition of the drawer 13 based on the pressing number, or number of times the input button 192*a* has been pressed within the elapsed reference time (S46).

When the pressing number of the input time within the reference time is 1, the drawer 13 is partly withdrawn (S49). When the pressing number within the reference time is 2 or more (S46), the drawer 13 is fully withdrawn (S47). Even when the pressing number is 1, the drawer 13 is driven only after the reference time has elapsed since the drawer 13 is driven in accordance with the final movement command that is determined after the reference time has elapsed and the pressing number is calculated.

When the drawer 13 is fully withdrawn (S47) and the input button 192*a* is pressed again (S48), the drawer 13 is inserted back into the refrigerator 10 (S57), regardless of an amount of time that has elapsed since opening. Alternatively, it is also possible to control the insertion distance of the drawer 13 based on the pressing time of the input button 192*a*.

When the drawer 13 is partly withdrawn (S49) and the input button 192*a* is pressed again (S50), the controller 810 again accumulates the number of times the input button 192*a* is pressed (S51), and at the same time, initiates a time count upon the initial pressing of the input button 192*a* (S52). The controller 810 again determines if a reference time has elapsed (S53) and also if the input button 192*a* has been pressed again during the reference time (S54). When the input button 192*a* has been pressed again during the reference time (S54), the controller 810 again accumulates the pressing number (S51). When the reference time has elapsed (S53), the pressing number is calculated (S55) and the driving condition of the drawer 13 is determined based on the pressing number (S56).

For example, when the input button 192*a* is pressed one time (i.e., pressing number=1) in a state where the drawer 13 is partly withdrawn, the drawer 13 is inserted back into the refrigerator 10 (S57). When the input button 192*a* is pressed two times or more, processes for fully withdrawing the drawer 13 are performed (S47).

Figure 10:
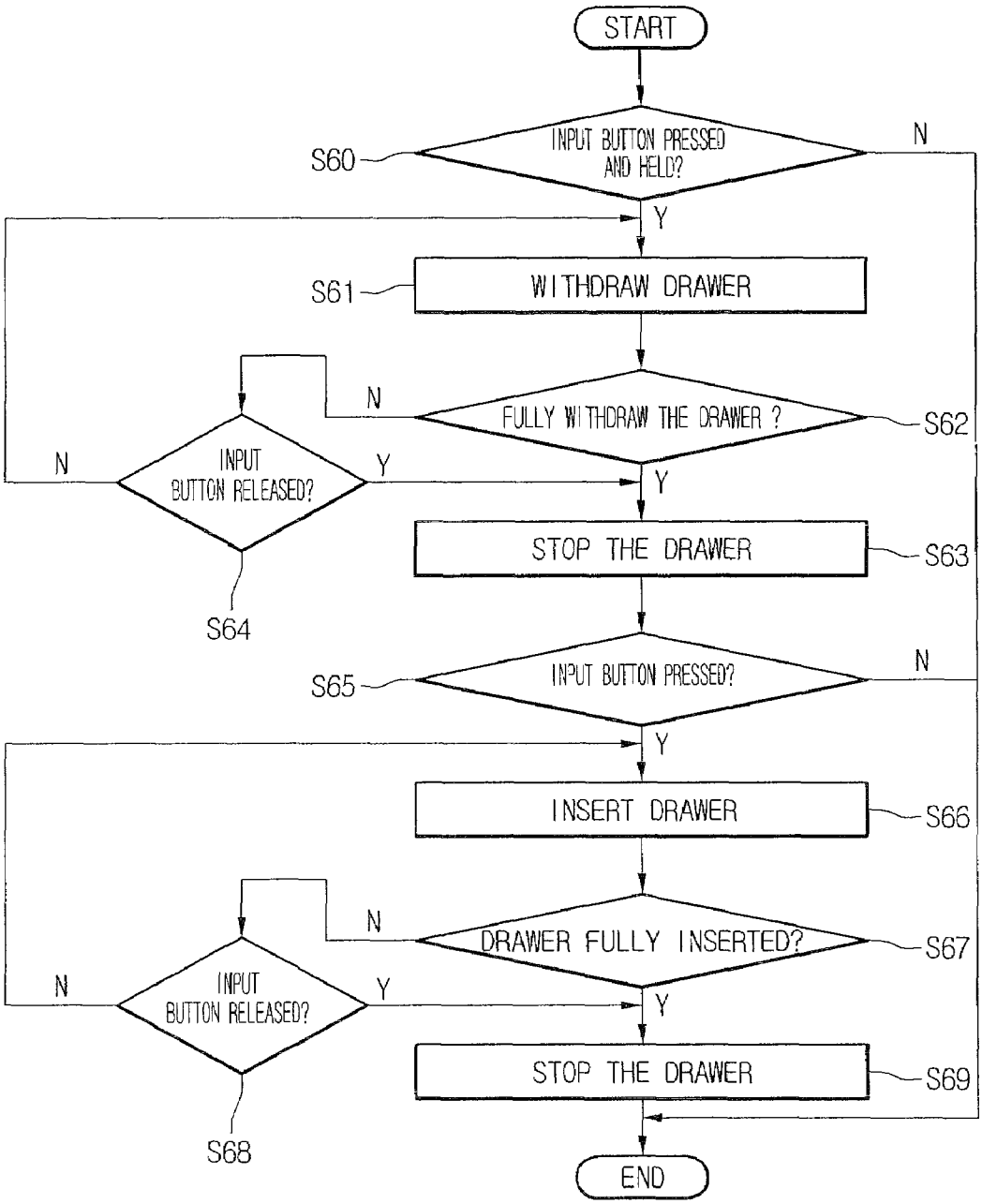
FIG. 10 is a flowchart of a method of driving a drawer of a refrigerator according to another embodiment as broadly described herein.

FIG. 10 is a flowchart of a method of driving a drawer of a refrigerator in which the drawer 13 is kept in a withdrawn or inserted state based on a held or released state of the input button 192*a*.

Right after the input button 192*a* is pressed (S60), the drawer 13 starts being withdrawn (S61) as the user continues to hold the input button 192*a* in a pressed condition (i.e., during the switch-on state), and the controller 810 determines if the drawer 13 is fully withdrawn (S62). When the drawer 13 is fully withdrawn, the controller 810 automatically stops the drawer 13 (S63). If instead the user releases the input button 192*a* (i.e., when the switch-on state is released) before the drawer 13 is fully withdrawn (S64), the controller 810 also stops the drawer 13 (S63).

When the drawer 13 is stopped (S63) in a partly or fully withdrawn state, the controller 810 determines if the input button 192*a* is pressed again (S65). Right after the input button 192*a* is pressed, the drawer 13 starts being inserted as the switch-on state is maintained (S66). The controller 810 determines if the drawer 13 is fully inserted (S67). If the switch-on state of the input button 192*a* is released before the drawer 13 is fully inserted (S68), the drawer stops moving (S69). In addition, when the drawer 13 is fully inserted, the drawer 13 stops moving even if the input button is still pressed and the switch-on state is maintained (S69). Thus, the user can flexibly determine a degree of the withdrawal or insertion of the drawer 13 based on how long the input button 192*a* is pressed and held.

In alternative embodiments, a movement distance, i.e., a distance the drawer 13 is moved either in the opening direction or the closing direction, may correspond directly to a switch-on state of the input button 192*a*. For example, if the drawer 13 is in a fully closed state and the input button 192*a* is pressed and held to initiate movement of the drawer 13 in the opening direction, the drawer 13 may continue to move in the opening direction until the input button is released 192*a*. The drawer 13 may be moved similarly in a closing direction. Thus, a movement amount of the drawer 13 may be directly varied by the user based on a press and hold time of the input button 192*a*.

In a refrigerator having a withdrawing structure for a storage box according to embodiments as broadly described herein, when a user simply pressing a storage box input button, the storage box may be automatically withdrawn or inserted, thus providing greater convenience of use. Moreover, because the storage box can be withdrawn automatically, the storage box can be conveniently withdrawn regardless of the weight of items stored in the storage box.

A separate handle is not required for withdrawing and inserting a storage box for a refrigerator. Thus, the refrigerator can has a clean exterior finish, utilization of the space in which the refrigerator is installed can be improved, and safety can be enhanced.

Because a drive motor for automatically withdrawing a storage box is not fixedly installed on the refrigerator main body, but is movably provided together with the storage box, an impaction on storage space of the refrigerator can be reduced.

Further, since the storage box can be brought to a stop at a specific position before the drawer box is fully withdrawn or fully inserted, cool air loss can be reduced and safety can be improved.

A controlling method for driving a drawer of a refrigerator as embodied and broadly described herein does not require a handle structure to move a storage box.

A controlling method for driving a drawer of a refrigerator as embodied and broadly described herein allows for automatic movement of a storage box according to a user's wishes, by means of an improved movement structure for a refrigerator storage box.

A controlling method for driving a drawer of a refrigerator as embodied and broadly described herein allows a user to stop the movement of a storage box at any point before it is completely withdrawn.

A method of driving a drawer of a refrigerator as embodied and broadly described herein may include inputting a drawer operation command through an input button; transferring the drawer operation command to a drive motor coupled to the drawer; and moving the drawer in accordance with the drawer operation command, wherein a moving condition of the drawer is determined in accordance with a pressing pattern of the input button.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of driving a drawer of a refrigerator having a storage compartment and a drawer slidably received in the storage compartment, the method comprising:

receiving a drawer operation command in response to a pressing of an input button;

transferring the drawer operation command to a drive motor coupled to a drawer, the drawer including a door and a storage box provided behind the door; and moving the drawer based on the pressing of the input button, comprising:

rotating the drive motor in a first direction and horizontally moving the drawer to withdraw the drawer from the storage compartment if the input button is pressed when the drawer is in an inserted position in the storage compartment; and rotating the drive motor in a second direction and horizontally moving the drawer to insert the drawer back into the storage compartment if the input button is pressed when the drawer is in a withdrawn position.

2. The method of claim 1, wherein moving the drawer based on the pressing of the input button comprises moving the drawer in multiple stages from a current position of the drawer.

3. The method of claim 2, wherein moving the drawer based on the pressing of the input button comprises:

rotating the drive motor in the first direction and partially withdrawing the drawer from the storage compartment when the input button is pressed a first time and the drawer is in an inserted position in the storage compartment; and rotating the drive motor in the first direction and fully withdrawing the drawer when the input button is pressed a second time and the drawer is in the partially withdrawn position.

4. The method of claim 3, further comprising rotating the drive motor in the second direction and inserting the drawer back into the storage compai talent when the input button is pressed a third time and the drawer is in a fully withdrawn position.

5. The method of claim 1, wherein moving the drawer based on the pressing of the input button further comprises moving the drawer based on an amount of time the input button is continuously pressed and held.

6. The method of claim 5, wherein moving the drawer based on an amount of time the input button is continuously pressed and held comprises partially withdrawing the drawer from the storage compartment when a hold time of the input button is less than a reference time and the drawer is in an inserted position in the storage compartment.

7. The method of claim 5, wherein moving the drawer based on an amount of time the input button is continuously pressed and held comprises fully withdrawing the drawer from the storage compartment when a hold time of the input button is greater than or equal to a reference time and the drawer is in the inserted position in the storage compartment.

8. The method of claim 5, further comprising partially inserting the drawer back into the storage compartment when a hold time of the input button is less than a reference time and the drawer is in a withdrawn position.

9. The method of claim 5, further comprising fully inserting the drawer back into the storage compartment when a hold time of the input button is greater than or equal to a reference time and the drawer is in a withdrawn position.

10. The method of claim 1, wherein moving the drawer based on the pressing of the input button comprises moving the drawer based on a number of times the input button is consecutively pressed.

11. The method of claim 10, wherein moving the drawer based on a number of times the input button is consecutively pressed comprises partially withdrawing the drawer from the storage compartment when a number of times the input button is consecutively pressed is less than or equal to a reference number and the drawer is in an inserted position in the storage compartment.

12. The method of claim 10, wherein moving the drawer based on a number of times the input button is consecutively pressed comprises fully withdrawing the drawer from the storage compartment when a number of times the input button is consecutively pressed is greater than a reference number and the drawer is in an inserted position in the storage compartment.

13. The method of claim 10, further comprising inserting the drawer back into the storage compartment when the number of times the input button is consecutively pressed within a predetermined amount of time is less than or equal to a reference number and the drawer is in a partially withdrawn position.

14. The method of claim 13, further comprising fully withdrawing the drawer from the storage compartment when the number of times the input button is consecutively pressed within the predetermined amount of time is greater than the reference number and the drawer is in the partially withdrawn position.

15. The method of claim 1, further comprising inserting the drawer back into the storage compartment if the input button is not pressed again within a predetermined amount of time after the drawer is withdrawn.

16. The method of claim 1, wherein receiving a drawer operation command in response to a pressing of an input button comprises receiving a plurality of different drawer operation commands in response to the pressing of a corresponding plurality of different input buttons.

* * * * *